US006669508B2

(12) United States Patent
Nakamura et al.

(10) Patent No.: US 6,669,508 B2
(45) Date of Patent: Dec. 30, 2003

(54) CONNECTOR

(75) Inventors: Hideto Nakamura, Yokkaichi (JP); Takeshi Tsuji, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/166,426

(22) Filed: Jun. 10, 2002

(65) Prior Publication Data

US 2002/0187677 A1 Dec. 12, 2002

(30) Foreign Application Priority Data

Jun. 11, 2001 (JP) ..... 2001-176014
Jul. 24, 2001 (JP) ..... 2001-223516
Aug. 10, 2001 (JP) ..... 2001-244348

(51) Int. Cl.[7] ..... H01R 13/422
(52) U.S. Cl. ..... 439/595
(58) Field of Search ..... 439/595, 752

(56) References Cited

U.S. PATENT DOCUMENTS 6,149,462 A * 11/2000 Sugie ..... 439/595
6,165,011 A * 12/2000 Fukuda ..... 439/595
6,179,660 B1 * 1/2001 Salaguinto et al. ..... 439/595
6,244,900 B1 * 6/2001 Ishikawa et al. ..... 439/595
6,322,391 B1 * 11/2001 Kodama ..... 439/595

FOREIGN PATENT DOCUMENTS

JP 6-325814 11/1994

* cited by examiner

*Primary Examiner*—Gary Paumen
(74) *Attorney, Agent, or Firm*—Anthony J. Casella; Gerald E. Hespos

(57) ABSTRACT

A connector has a housing (20; 50) with cavities (23) for receiving terminal fittings (10; 60). At least a portion of each cavity (23) is rectangular and is dimensioned to receive a rectangular tube portion (11) of the terminal fitting (10; 60). At least one corner of the rectangular tube (11) defines an engaging recess (17; 61). At least one L-shaped lock (29; 51) is cantilevered forward adjacent each cavity (23) and is resiliently deflectable diagonally away from the rectangular portion of the respective cavity (23) in response to insertion of the terminal fitting (10; 60) into the respective cavity (23). The lock (29; 51) returns resiliently after proper insertion of the terminal fitting (10; 60) to engage the recess (17; 61).

19 Claims, 14 Drawing Sheets

CONNECTOR

BACKGROUND OF THE INVENTION

1. Field of the Invention

The invention relates to a connector with a locking portion for locking a terminal fitting.

2. Description of the Related Art

Japanese Unexamined Patent Publication No. 6-325814 and FIG. 16 herein both show a known connector. With reference to FIG. 16, the connector has a housing 1 and terminal fittings 2 that are inserted into each of a plurality of cavities 3 arranged transversely at two stages in the housing 1. Locks 4 are provided at the upper surfaces of the respective cavities 3 and are deformable to enter deformation-permitting spaces 5 above the cavities 3. Each lock 4 is deformed resiliently and enters the deformation permitting space 5 when the corresponding terminal fitting 2 is inserted into the cavity 3. The lock 4 is restored resiliently to its original shape when the terminal fitting 2 is inserted to a proper depth. Thus, the lock engages the terminal fitting 2 and locks the terminal fitting 2 in the cavity 3.

A demand has existed in recent years to make connectors smaller. Consideration has been given to meeting this demand by reducing the thickness of the locks 4 and making the deformation permitting spaces 5 smaller in an effort to reduce the interval of the cavities 3. However, thinner locks 4 are deformed more easily. Thus, the terminal fittings 2 are pulled out of the cavities 3 more easily. Further, a smaller degree of resilient deformation of the locks 4 reduces the engaging areas of the locks 4 with the terminal fittings 2. This also makes the terminal fittings 2 easier to withdraw from the cavities 3, and a sufficient locking force cannot be attained.

Consideration also has been given to reducing the vertical dimension of the connector by providing the locks at the side surfaces of the cavities and resiliently deforming the locks in a horizontal direction. This necessarily results in a wider connector.

In view of the above problems, an object of the present invention is to provide a connector that can be made smaller while ensuring a sufficient locking force of a locking portion for locking a terminal fitting.

SUMMARY OF THE INVENTION

The invention is directed to a connector with a housing that has a plurality of cavities arranged along an arranging direction. Terminal fittings are insertable into the respective cavities along an inserting direction. At least one lock is formed at the inner surfaces of each cavity and has a locking section configured for engaging the respective terminal fitting. The locks are resiliently deformable in directions oblique to the terminal inserting direction and hence oblique to a direction normal to the inserting direction of the terminal fitting.

Each lock extends along the inserting direction of the terminal fittings and has a substantially L-shaped cross section with a first section that extends along the arranging direction of the cavities and a second section that extends along a direction normal thereto. Thus, each L-shaped portion of each lock defines a concave right angle corner that faces into the cavity.

Each lock is arranged at a corner of the corresponding cavity and conforms to the shape of the corner. Thus, each lock serves also as a surrounding wall that at least partly surrounds the corresponding cavity. Consequently, the connector can be made smaller as compared to a case where the lock and the deformation permitting space are formed inside a surrounding wall of the cavity.

A pair of locks may be provided for each cavity and the locks in each pair may be disposed at adjacent corners of the cavity. Both locks in each pair may have an L-shaped cross-section, with concave corners facing into the corresponding cavity. First sections of the L-shaped locks may be substantially coplanar, and second sections of the L-shaped locks may be substantially parallel to one another and orthogonal to the plane of the first sections. The provision of locks at adjacent corners of each cavity achieves large contact areas and high locking forces even though each lock is small and thin.

Each lock may be deformed resiliently in the direction oblique to the arranging direction of the cavities. Thus, dimensions of a necessary deformation permitting space along the vertical and horizontal directions of the housing can be smaller than an amount of resilient deformation of the lock in its deforming direction. As a result, the connector can be made smaller by reducing an arrangement interval of the cavities while ensuring sufficient locking forces for locking the terminal fittings. Additionally the deformation of each lock along a diagonal direction utilizes an area of the housing that normally would be dead space. Thus, space is utilized efficiently.

The substantially L-shaped cross section of each lock improves rigidity upon deformation, and a sufficient locking force can be ensured even if the lock is thinned. Therefore, the connector can be made even smaller.

Jig insertion openings may be formed at the front of the housing and may be aligned with the respective locks. A jig may be inserted into a jig insertion opening for deflecting the corresponding lock out of engagement with the terminal fitting. Thus, the terminal fitting may be removed for maintenance. Housings that have two locks for each cavity may have a jig insertion opening aligned between the locks in each pair so that a single jig can deflect both locks in the cavity to enable removal of the corresponding terminal fitting.

DETAILED DESCRIPTION OF THE PREFERRED EMBODIMENTS

A connector according to a first embodiment of the invention comprises a female housing 20 with four female terminal fittings 10 and a retainer 40 for holding the female terminal fittings 10 in the female housing 20, as shown in FIGS. 1–10. The female housing 20 is connectable with a male housing (not shown) provided with male terminal fittings. In the following description, an inserting direction of the female terminal fittings into the female connector housing is referred to as forward direction.

Figure 1:
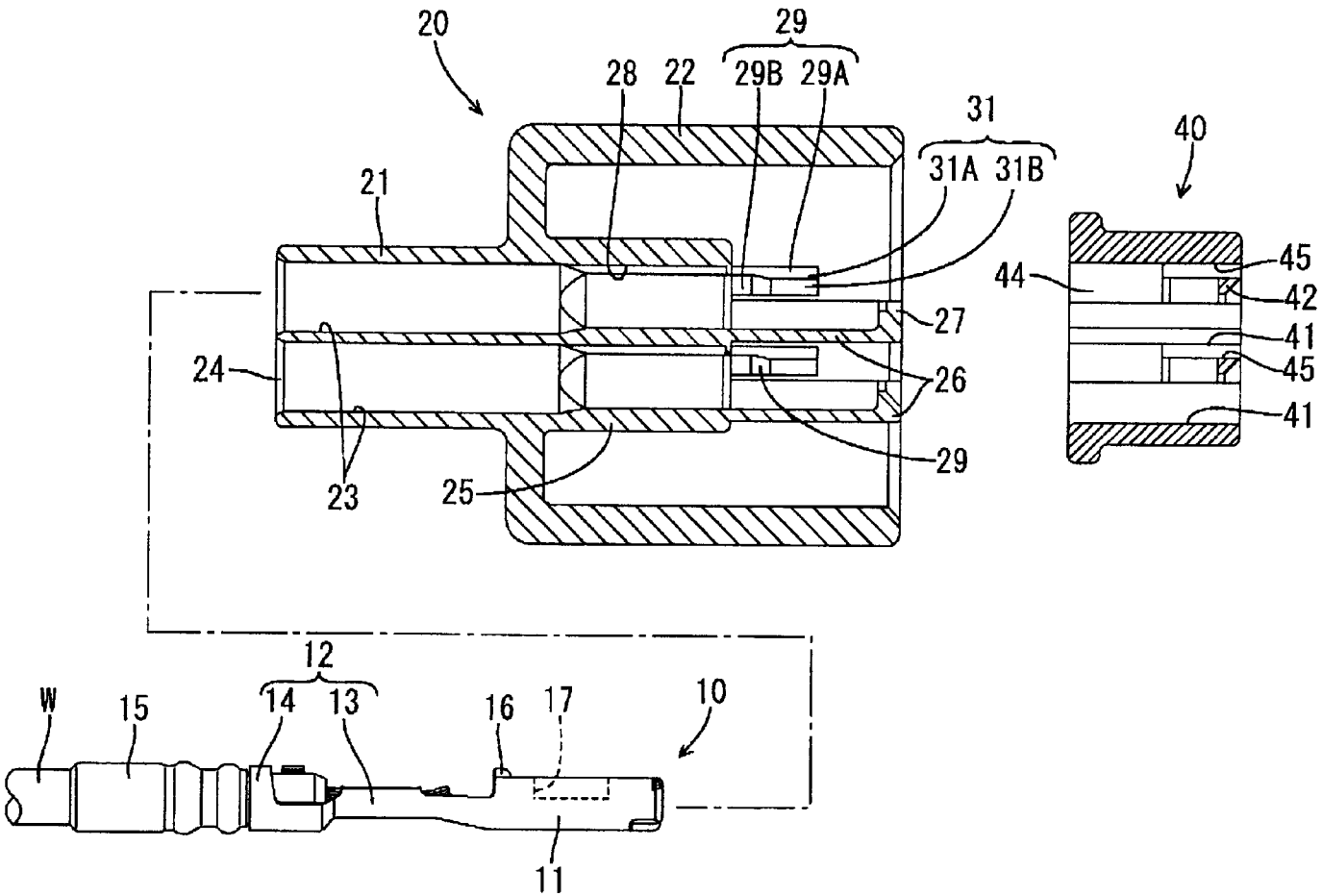
FIG. 1 is an exploded section of a connector according to a first embodiment of the present invention.

Each female terminal fitting 10 is formed by stamping an electrically conductive metallic plate into a specified shape and then bending the stamped plate. The female terminal fitting 10 has opposite front and rear ends, as shown in FIG. 1. A rectangular tube 11 is formed at the front end and is configured for connection with a male tab of the corresponding male terminal fitting. A barrel 12 is formed at the rear end of the female terminal fitting 10 and is configured for connection with an end of a wire W. The barrel 12 includes a wire barrel 13 with two crimping pieces that extend respectively from the left and right sides of a bottom plate thereof. The crimping pieces of the wire barrel 13 are crimped from above into connection with a core of the wire W. The barrel also includes an insulation barrel 14 with two crimping pieces that are crimped from above into connection with an insulated portion of the wire W and with a rubber plug 15 that has been fitted on the insulated portion.

The rectangular tube 11 has an open front end and a resilient contact piece inside. The male tab can be inserted through the open front end of the rectangular 11, and into contact with the resilient contact piece to establish electrical connection. A stabilizer 16 projects from the upper surface of the rectangular tube 11 at the widthwise center of the rear end of the upper surface. Two side portions of the metallic plate are placed one over the other to define the upper wall of the rectangular tube 11. A recessed engaging portion 17 is formed by cutting off a section of the surrounding wall of the rectangular tube 11 including an upper right corner and upper portions of the adjacent side wall near the center of the rectangular tube 11 with respect to forward and backward directions.

Figure 2:
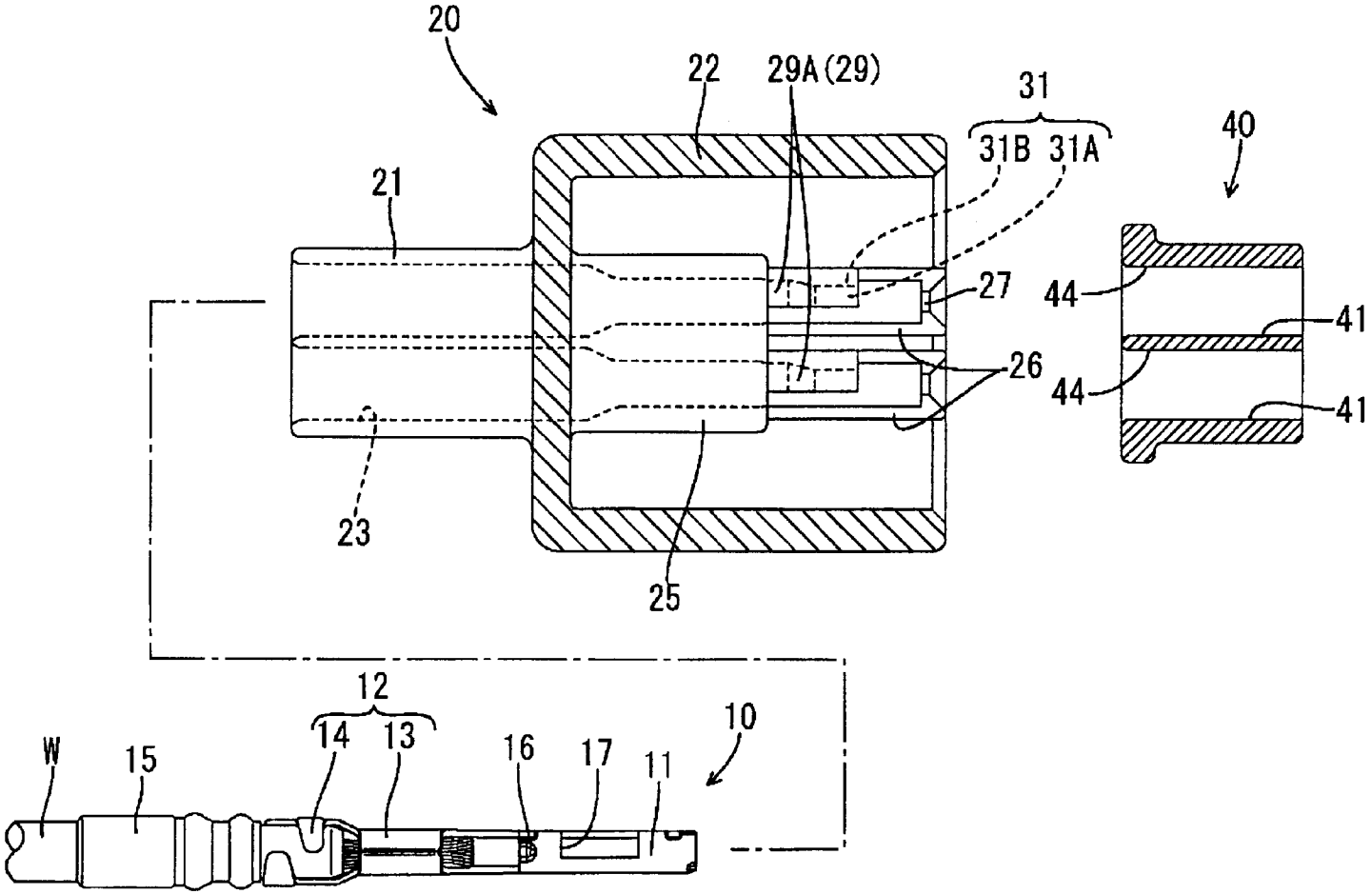
FIG. 2 is an exploded top plan view of the connector partly in section.
Figure 4:
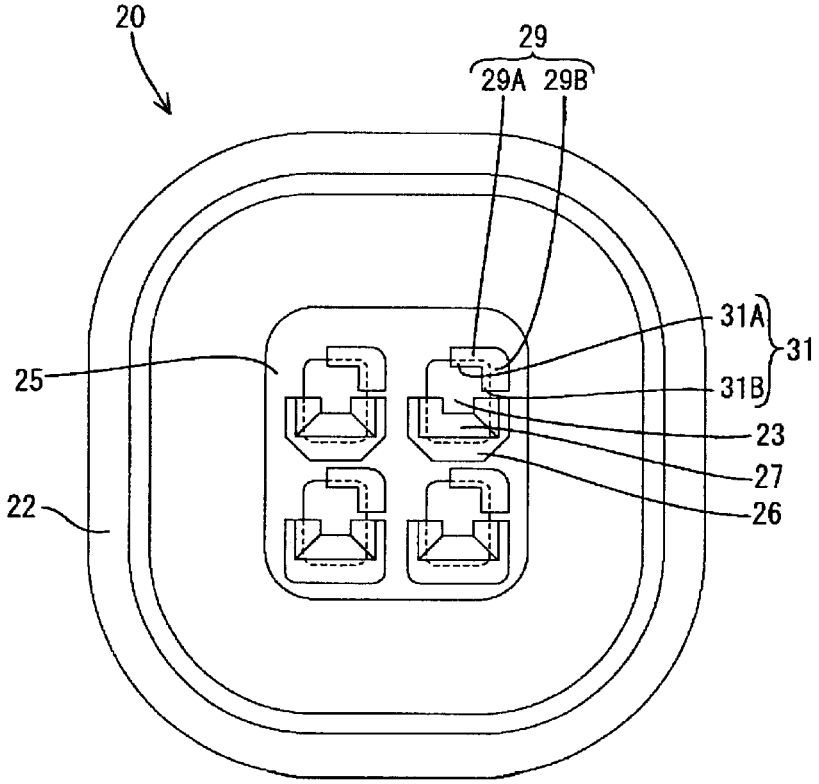
FIG. 4 is a front view of a connector housing.
Figure 5:
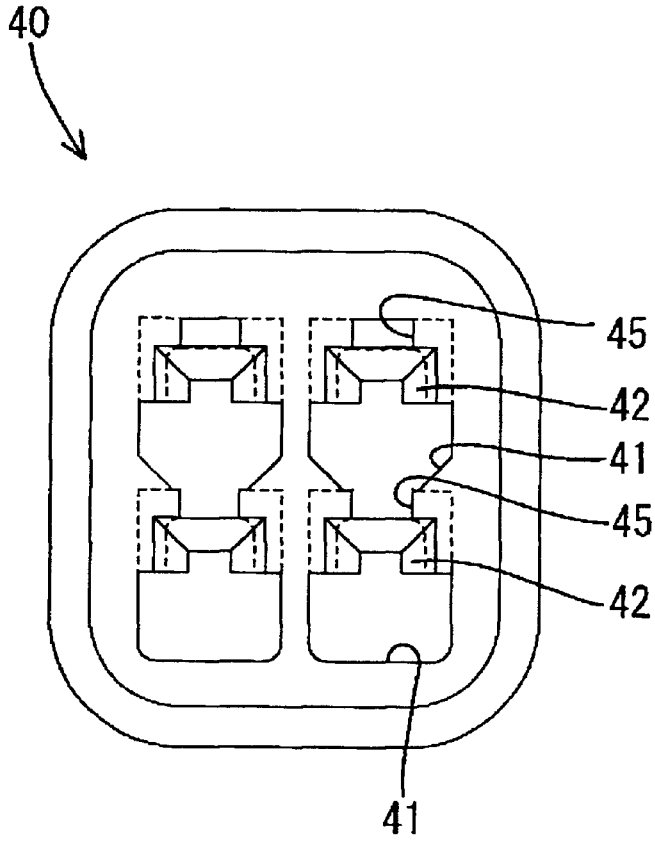
FIG. 5 is a front view of a retainer.
Figure 6:
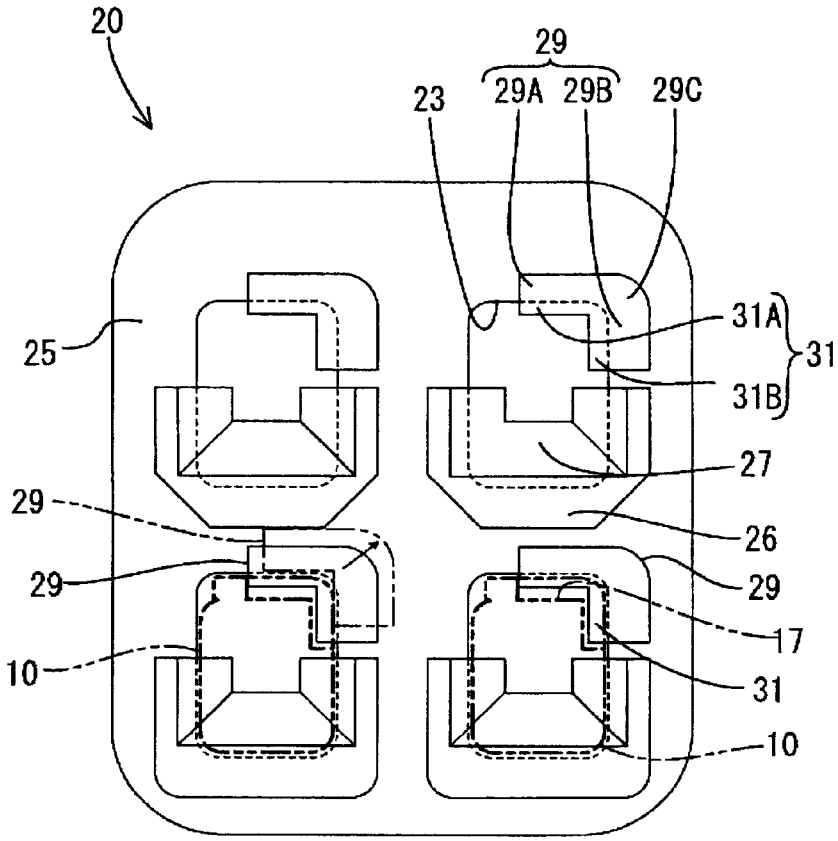
FIG. 6 is a fragmentary front view of the housing showing a movement of the lock.

The female housing 20 is made of synthetic resin, and has a long narrow terminal-mounting portion 21. A substantially rectangular tubular receptacle 22 surrounds a front half of the terminal-mounting portion 21, as shown in FIGS. 1 and 2, and is configured to receive the male connector housing. Cavities 23 are formed inside the terminal mounting portion 21 and are arranged at each of two horizontal stages as shown in FIGS. 1, 2 and 4. A terminal insertion opening 24 is formed at the rear end of each cavity 23 for receiving the respective female terminal fitting 10. Portions of each cavity 23 adjacent the terminal insertion opening 24 define a round cross section dimensioned for hermetic sealing engagement with the rubber plug 15. The front half of each cavity 23 has a substantially rectangular cross section corresponding to the outer shape of the rectangular tube 11. A guide groove 28 extends in forward and backward directions in the ceiling surface of each cavity 23. The stabilizer 16 enters the guide groove 28 during insertion of the female terminal fitting 10 to stabilize and orient the terminal fitting 10.

The terminal mounting portion 21 has a rectangular portion 25 that extends between the back surface of the receptacle 22 and a substantially center position of the receptacle 22. Long narrow projections 26 project forward from the rectangular portion 25 in correspondence with the respective cavities 23. Each projection 26 covers substantially a bottom half of a front end of the female terminal fitting 10 inserted into each cavity 23. A front wall 27 is formed at the front end of the projection 26 to define the front end position of the inserted female terminal fitting 10. The front wall 27 forms a bottom half of an edge of a tab insertion opening through which the male tab of the male terminal fitting is insertable.

Figure 3:
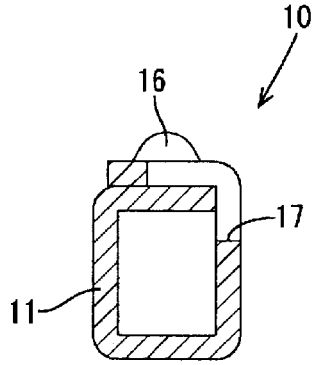
FIG. 3 is a cross sectional view of the terminal fitting taken along a line perpendicular to the axis of the terminal fitting.

A lock 29 for locking the female terminal fitting 10 projects from the front end of the rectangular portion 25 above the projection 26 that corresponds to the respective cavity 23. Each lock 29 projects forward by a distance that is about half the length of the respective projection 26, and is comprised of an upper wall 29A that extends along the horizontal direction of the female connector housing 20 and a side wall 29B that extends along the vertical direction thereof. Thus, each lock 29 has a substantially L-shaped cross section, as shown in FIG. 3 and defines a concave corner that faces inwardly. Further, each lock 29 is arranged at the upper right corner of the corresponding cavity 23 when viewed from front and conforms to the shape of the corner.

A locking section 31 projects at the leading end of each lock 29 and is engageable with the engaging portion 17 of the corresponding female terminal fitting 10. More specifically, the locking section 31 projects toward the inside of the cavity 23 from an area including a corner portion 29C (see upper right position of FIG. 6) of the lock 29, and is comprised integrally of a downward projection 31A that projects down from the upper wall 29A of the lock 29 and a lateral projection 31B that projects leftward from the side wall 29B, to define an L-shaped cross section. Moderately sloped surfaces are formed on rear sides of the projections 31A, 31B, and the front surfaces of the two projections 31A, 31B align with the front end surface of the lock 29. The lock 29 is formed to be thin and resiliently deformable in an upper-right direction when viewed from front (direction indicated by an arrow of FIG. 6).

The retainer 40 is made of a synthetic resin and defines a substantially rectangular parallelepipedic shape, as shown in FIGS. 1 and 4. Through holes 41 penetrate the retainer 40 in forward and backward directions at positions corresponding to the respective cavities 23. The retainer 40 is mountable on the front side of the rectangular portion 25 so that the projections 26 fit into the through holes 41. A front wall 42 is formed at the upper part of the front end of each through hole 41 and forms an upper half of the edge of the tab insertion opening through which the male tab is insertable. More particularly, the front wall 42 of the retainer 40 is aligned with the front wall 27 of the corresponding projection 26 when the retainer 40 is mounted at a full locking position in the female housing 20. A deformation preventing portion 44 is formed on the inner wall of each through hole 41 and can be disposed along the outer side surface of the side wall 29B of the lock 29 to prevent deformation of the lock 29. The retainer 40 can be held at two positions by an unillustrated positioning means, namely, a full locking position (see FIG. 7) where the deformation preventing portions 44 prevent the deformation of the locks 29 and a partial locking position (see FIG. 5) where the deformation preventing portions 44 are retracted forward from the full locking position to permit the deformation of the locks 29. Jig insertion openings 45 penetrate the front surface of the retainer 40 at positions above the respective front walls 42, and a jig (not shown) is insertable through the jig insertion openings 45 to disengage the locks 29.

Figure 7:
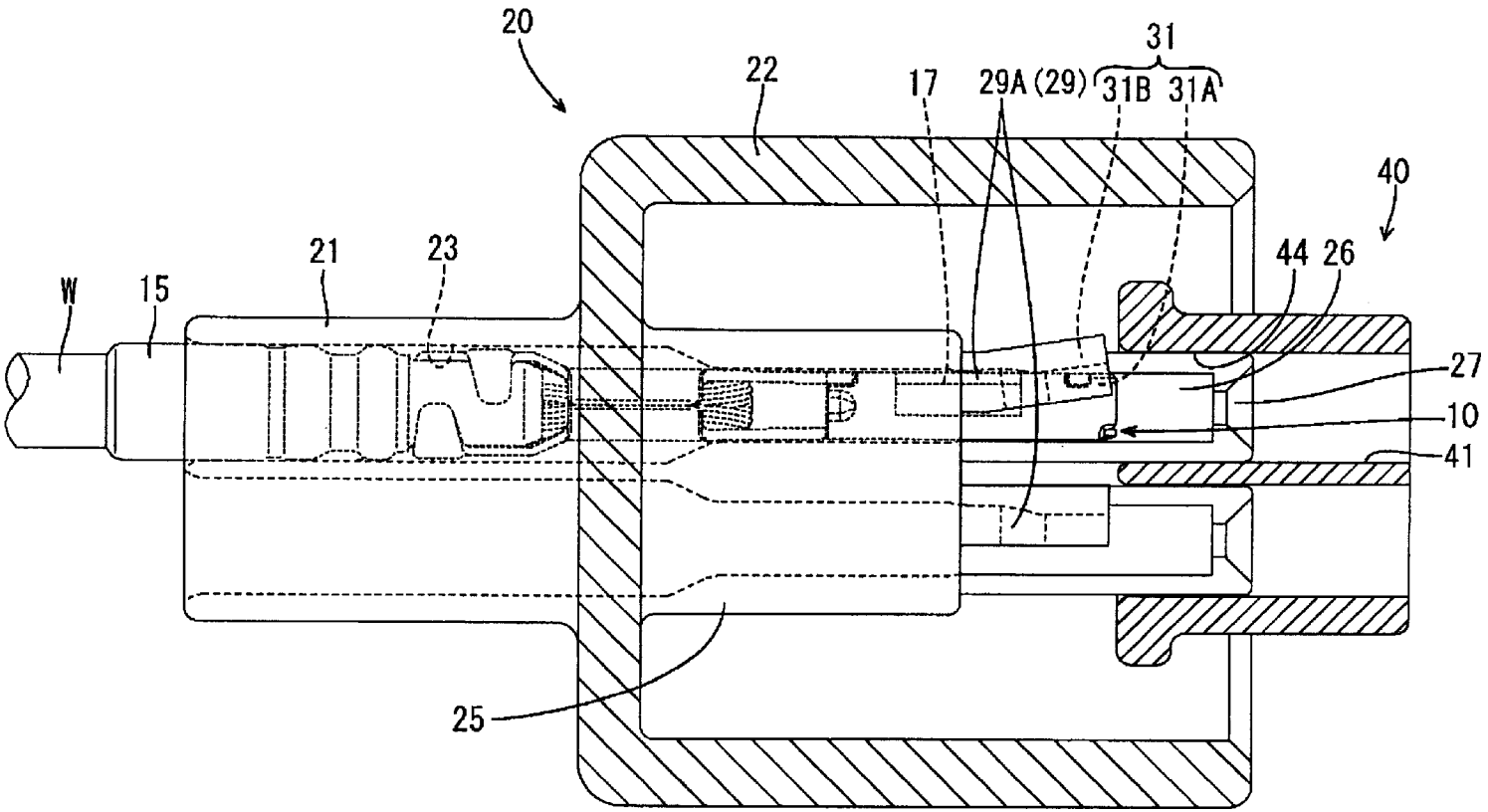
FIG. 7 is a longitudinal horizontal section showing a state where the lock is deformed resiliently.
Figure 8:
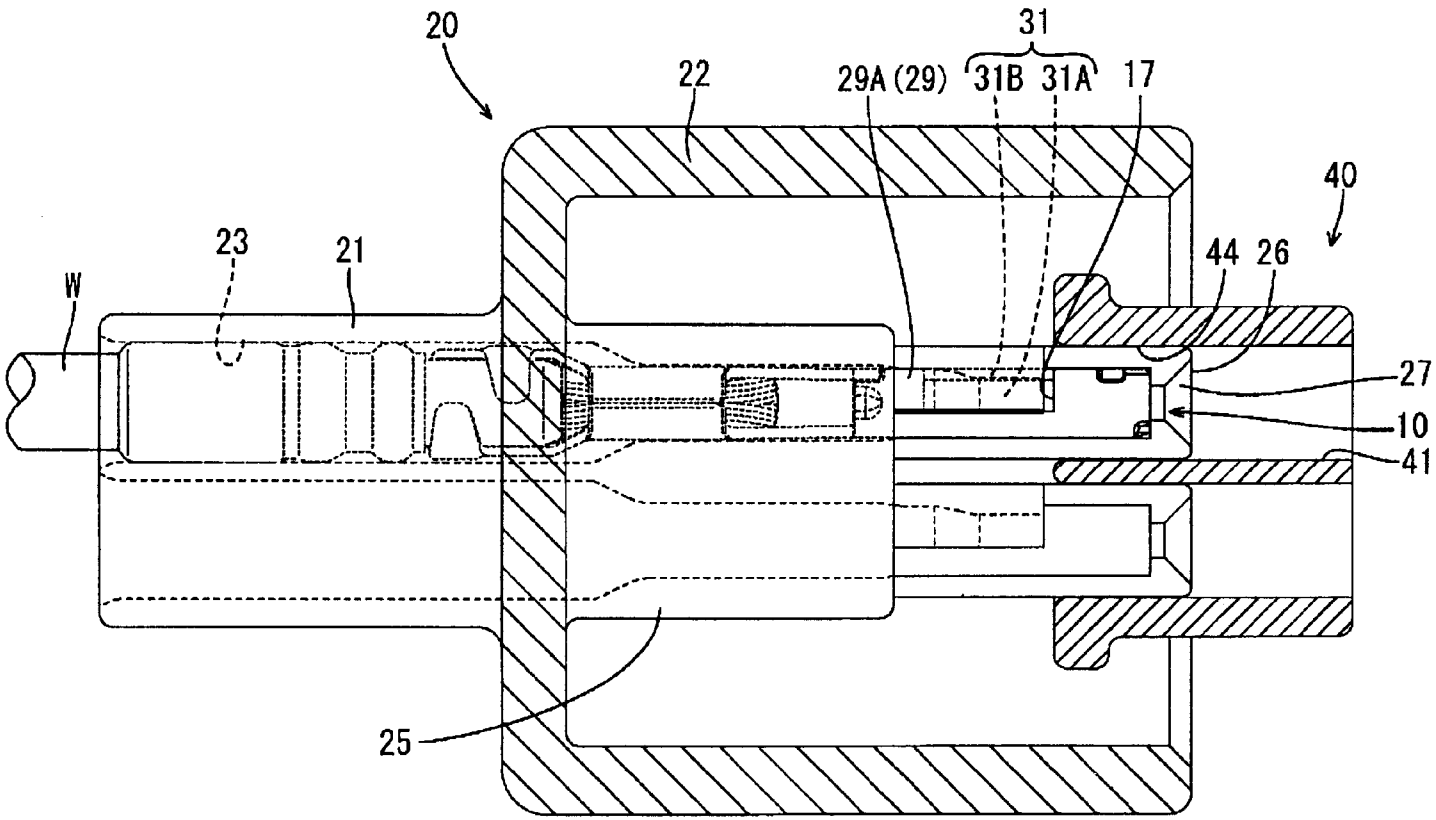
FIG. 8 is a longitudinal horizontal section showing a state where the lock is engaged with a female terminal fitting.

The connector is assembled by first holding the retainer 40 at the partial locking position shown in FIGS. 7 and 8. The female terminal fittings 10 then are inserted into the cavities 23 through the terminal insertion openings 24. The leading end of each rectangular tube 11 contacts the locking section 31 of the corresponding lock 29 and the lock 29 is deformed resiliently in an oblique direction, i.e. the upper right direction in FIG. 7 and the direction indicated by the arrow in FIG. 6. More particularly, the lock 29 is pushed up and to the right along the slanted surfaces of the downward projection 31A and the downward projection 31B.

The female terminal fitting 10 eventually reaches a proper position and contacts the front wall 27. The lock 29 then is restored resiliently to its original shape and the locking section 31 enters the engaging portion 17, as shown in FIG. 8. As a result, the female terminal fitting 10 is locked partially.

Figure 9:
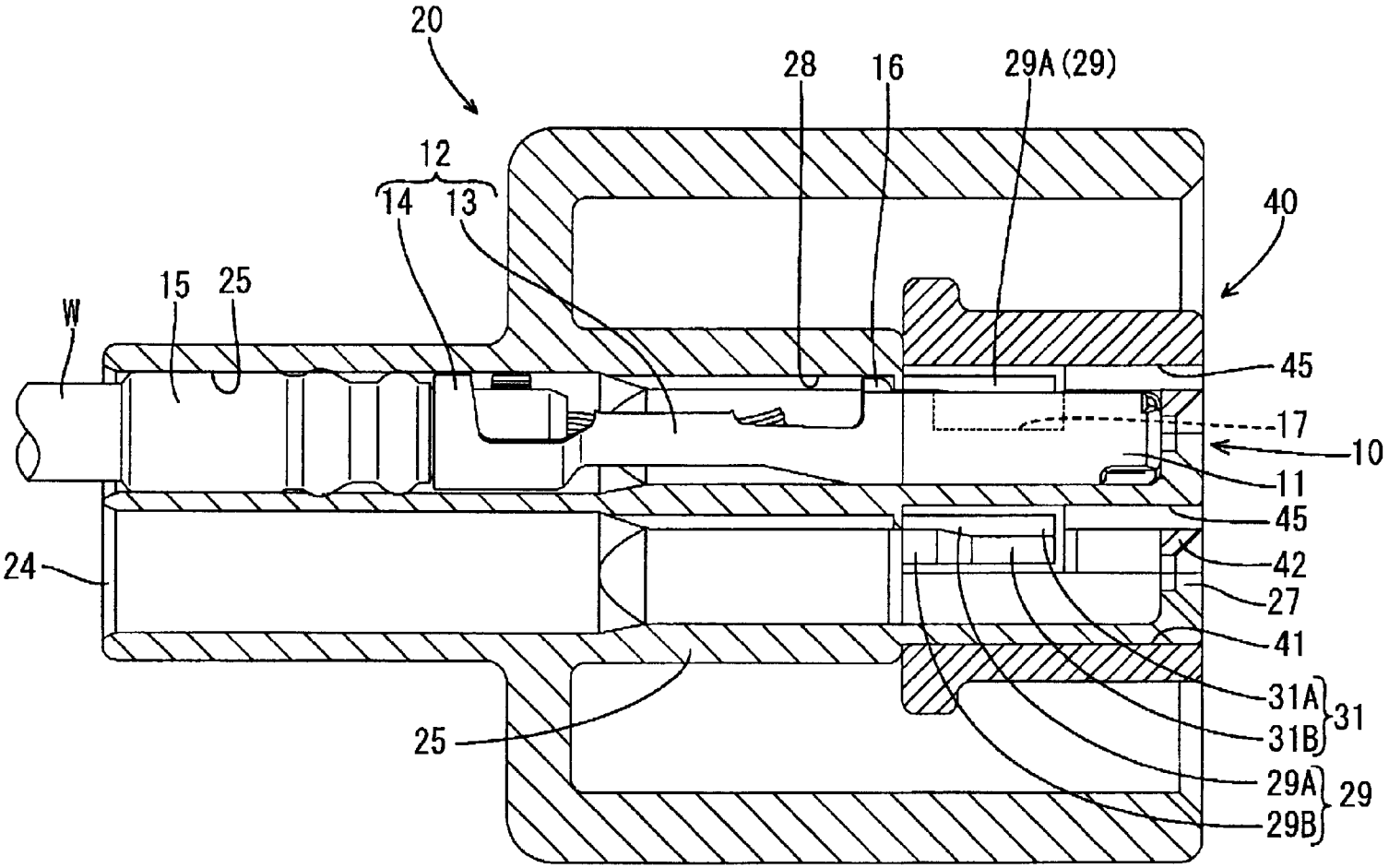
FIG. 9 is a longitudinal vertical section showing a state where the retainer is mounted at a full locking position.
Figure 10:
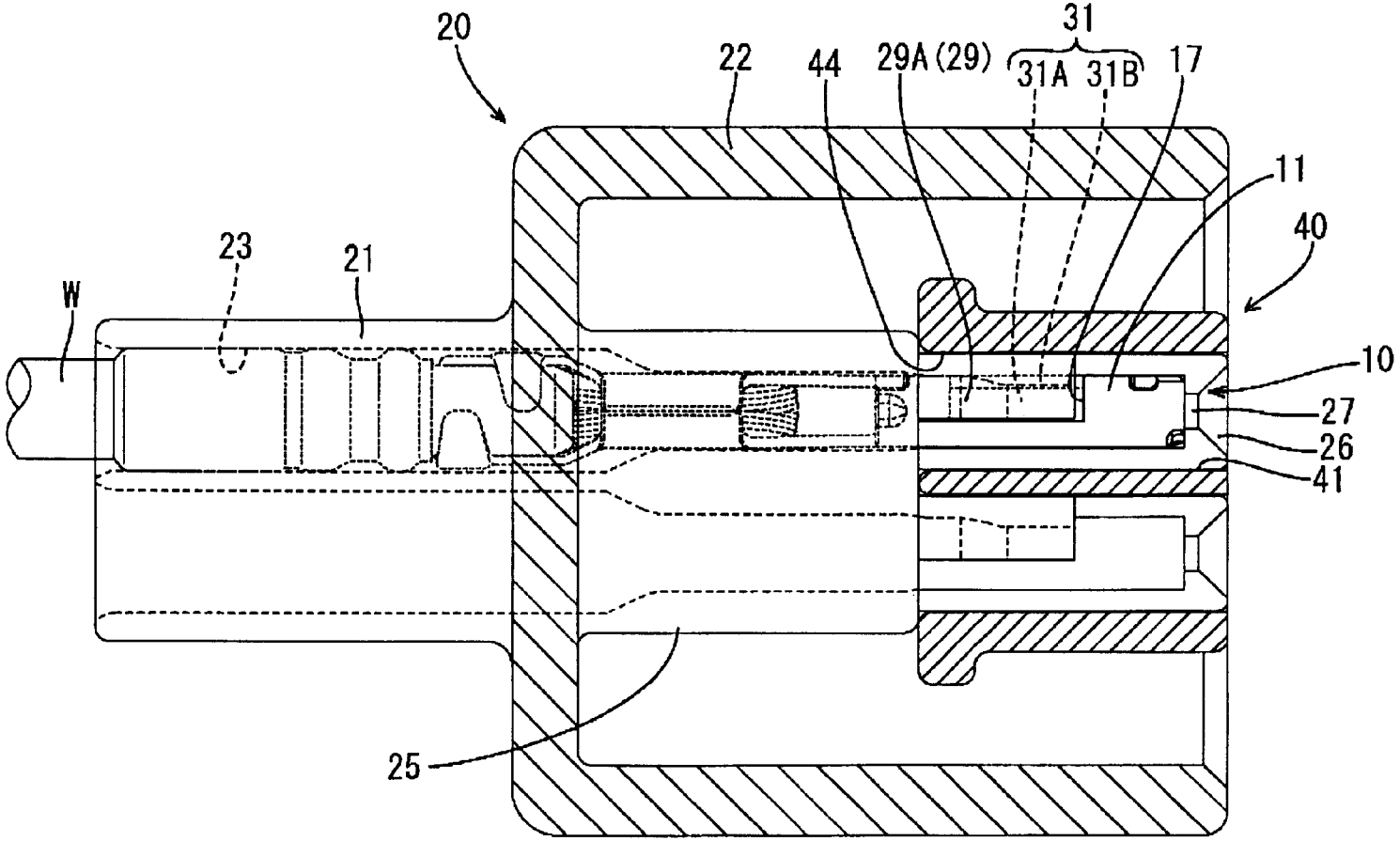
FIG. 10 is a longitudinal horizontal section showing the state of FIG. 9.
Figure 11:
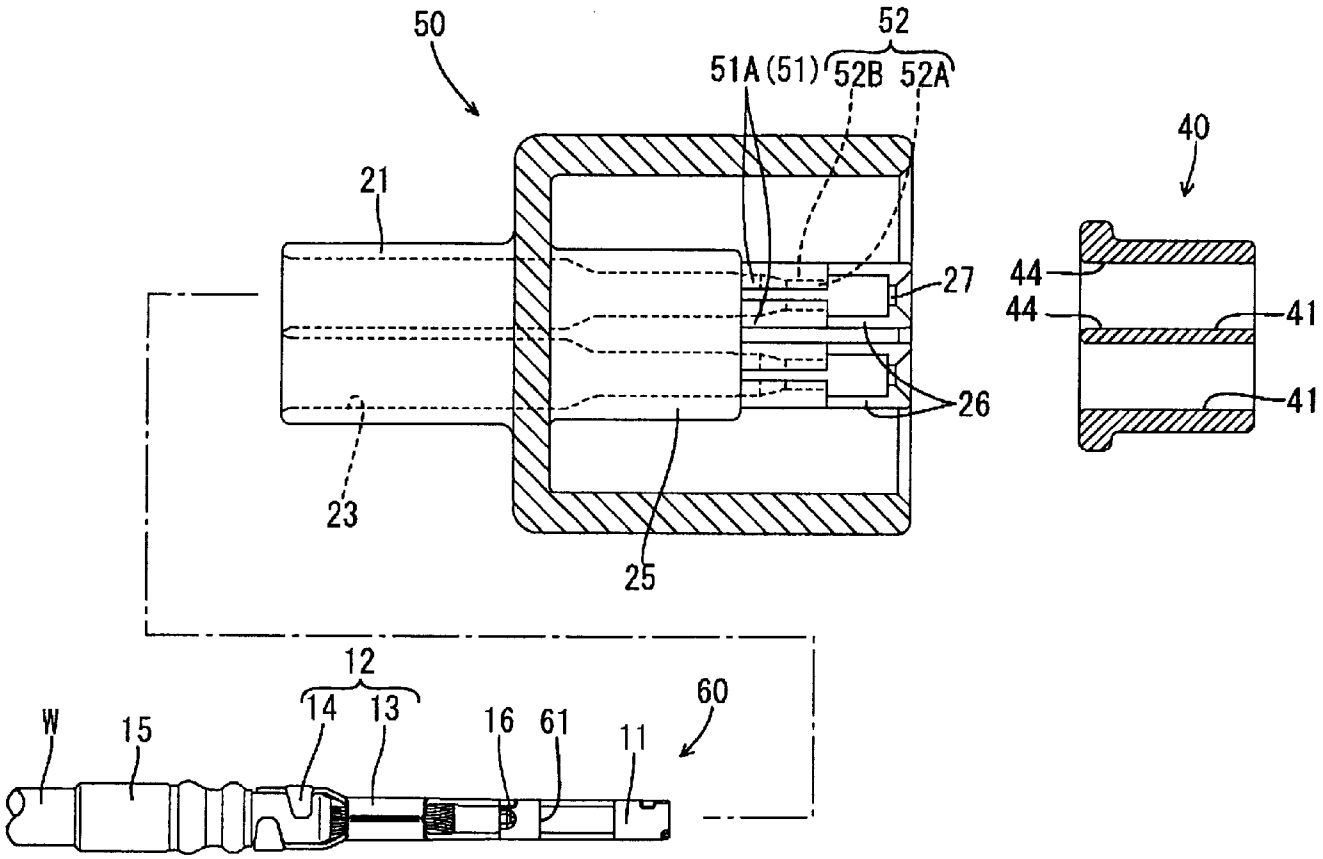
FIG. 11 is a top plan view, partly in section, of a second embodiment of a connector in accordance with the subject invention.
Figure 12:
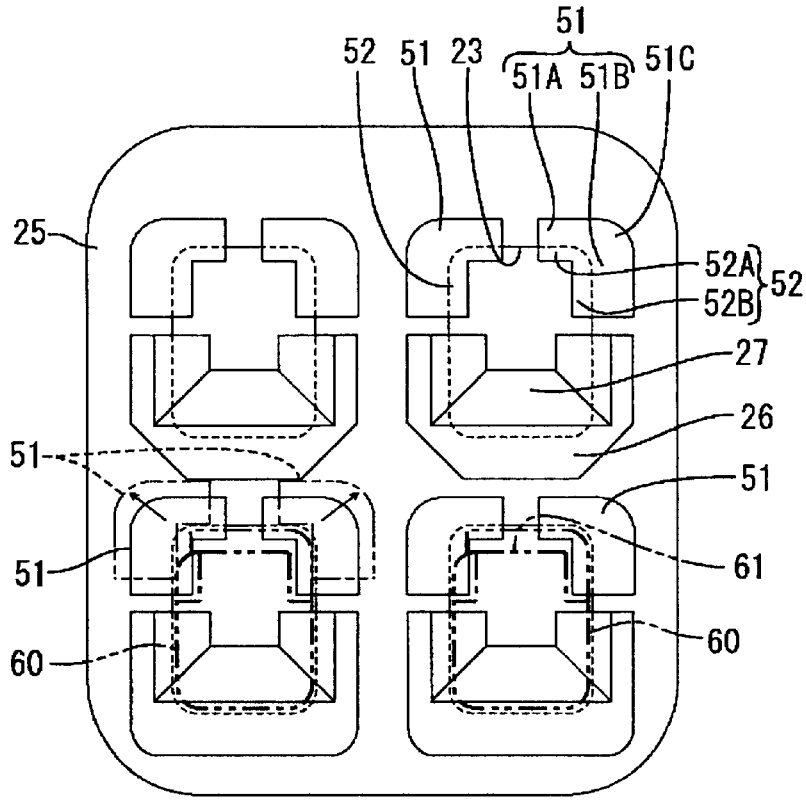
FIG. 12 is a fragmentary front view of the housing of FIG. 11 showing movement of the locks.
Figure 13:
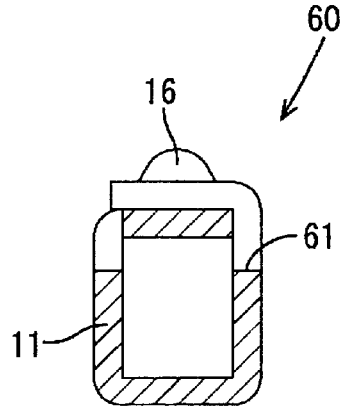
FIG. 13 is a cross-sectional view of the female terminal fitting taken along a section perpendicular to the axis of the terminal fitting.

The retainer 40 is pushed back and is held at the full locking position, as shown in FIG. 9, after the female terminal fittings are mounted in the cavities 23. Thus, the deformation preventing portions 44 are along the outer surfaces of the side walls 29B of the respective locks 29 to prevent deformation of the locks 29 and to lock the female terminal fittings 10 doubly. In this way, the assembling of the female connector is completed.

If any of the female terminal fittings 10 erroneously is inserted only partly during the above operation process, the opening edge of the through hole 41 contacts the leading end of the lock 29 to prevent movement of the retainer 40 when an attempt is made to move the retainer 40 to the full locking position. Thus, an operator can notice an insufficient insertion of the female terminal fitting 10.

As described above, according to this embodiment, the lock 29 has a substantially L-shaped cross section with two sides that extend respectively along the arranging direction of the cavities 23 and a direction normal thereto, i.e. vertical and horizontal directions. Thus, the entire lock 29 has an improved rigidity, and a sufficient locking force for locking the female terminal fitting 10 can be ensured even if the lock 29 is thinned. Therefore, the connector can be made even smaller with respect to vertical and horizontal directions of the housing 20. Further, the locking section 31 is provided in the rigid corner 29C. Therefore, a large locking force can be attained as compared to a case where a locking section is at another part (e.g. side end of the upper wall opposite from the corner portion) of the lock, and the lock 29 can be made even thinner.

The locks 29 are deformed in the directions oblique to the arranging direction (vertical or horizontal direction) of the cavities 23. Therefore, dimensions of a necessary deformation permitting space along the vertical and horizontal directions of the housing 20 can be smaller than an amount of resilient deformation of the locks 29 in their deforming direction. Thus, the connector can be made smaller by reducing the arrangement interval of the cavities 23 while ensuring sufficient locking forces for locking the female terminal fittings 10.

A dead space generally exists in an area of the surrounding wall around the cavity in a direction diagonal to the cavity. In this embodiment, the lock 29 has a substantially L-shaped cross section at the corner of the cavity and conforms to the shape of this corner. Thus, the lock 29 can be deformed in the diagonal direction and, therefore, space can be used efficiently.

Further, the locking section 31 engages the female terminal fitting 10 in two directions normal to each other. Thus, an improved locking force can be attained as compared to the conventional locking portion that engages the terminal fitting from one side.

A second embodiment of the connector of the subject invention is illustrated in FIGS. 11–15. The connector of FIGS. 11–15 has several components that are structurally and functionally similar to components described and illustrated with respect to the embodiment of FIGS. 1–10. These similar components are not described again and are identified by the same reference numerals.

The connector of FIGS. 11–15 comprises a housing 50 with four female terminal fittings 60. Each female terminal fitting 60 is similar to the female terminal fittings 10 of the first embodiment, and includes a rectangular tube 11. However, a recessed engaging portion 61 is formed by cutting off sections, including the upper left and upper right corners and about half of the left and right side walls at locations about centrally along the length of the rectangular tube 11.

The housing 50 of the second embodiment is similar to the housing 20 of the first embodiment. In particular, the housing 50 has a terminal mounting portion 21 and a receptacle 22 that surrounds and is spaced from a rectangular front section 25 of the terminal accommodating portion 21. The terminal accommodating portion 21 has four cavities 23 for receiving the terminal fittings 60.

The housing 50 has two locks 51 for each cavity 23. The locks 51 project from the front end of the rectangular portion 25 above the projecting portion 26 and are configured for locking the female terminal fittings 60 in the respective cavities 23. Each lock 51 projects forward by a distance about half the length of the projecting portions 26, and is comprised of an upper wall 51A that extends along the horizontal direction of the female connector housing 50 and a side wall 51B that extends along the vertical direction thereof. Thus, each lock 51 has a substantially L-shaped cross section. Further, the locks 51 for each cavity 23 are arranged at adjacent upper corners of the cavity 23 and conform to the shapes of the corners. Locking sections 52 project from the leading ends of the locks 51 for engaging the female terminal fittings 60. More specifically, each locking section 52 projects toward the inside of the cavity 23 from an area including a corner 51C of the lock 51 (see upper-right position of FIG. 12) and is integrally comprised of a downward projection 52A that projects down from the upper wall 51A of the lock 51 and a lateral projection 52B that projects laterally from the side wall 51B. Thus, each locking section 52 has an L-shaped cross section that is concave towards the interior of the respective cavity 23. Each lock 51 is thin and is resiliently deformable in an oblique upward direction to depart from each other (see arrows of FIG. 12).

Figure 14:
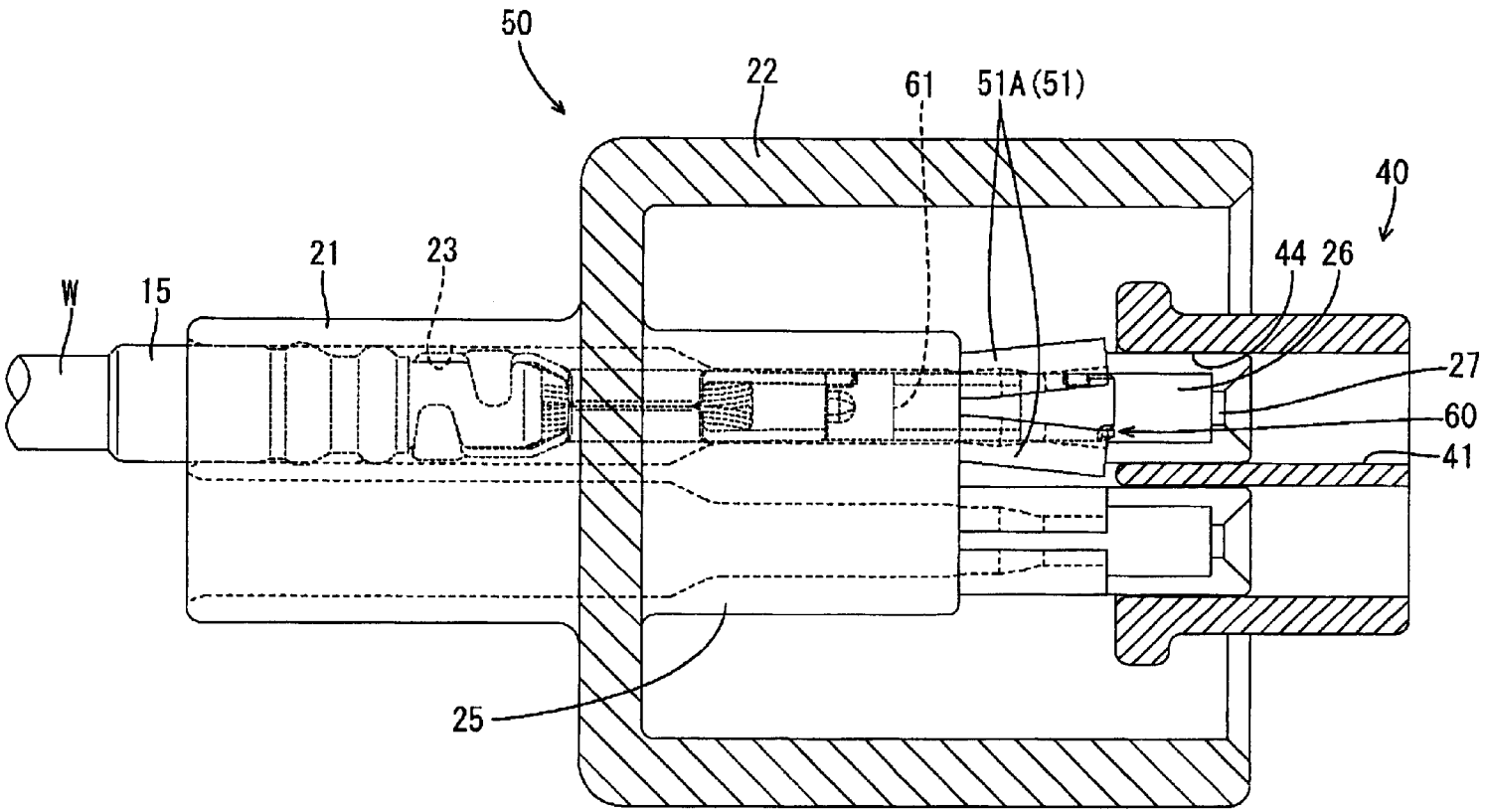
FIG. 14 is a top plan view, partly in section, of the connector of the second embodiment.

The female terminal fittings 60 are mounted into the female connector housing 50 with the retainer 40 held at the partial locking position before the rectangular portion 25, as shown in FIG. 14. More particularly, the female terminal fitting 60 is inserted into the cavity 23 from the rear through the terminal insertion opening 24. The locks 51 of each pair deform obliquely up and away from each other as shown in FIG. 14 and by arrows of FIG. 12 when the leading end of the rectangular tube 11 moves along the slanted surfaces of the downward projections 52A and the lateral projections 52B.

Figure 15:
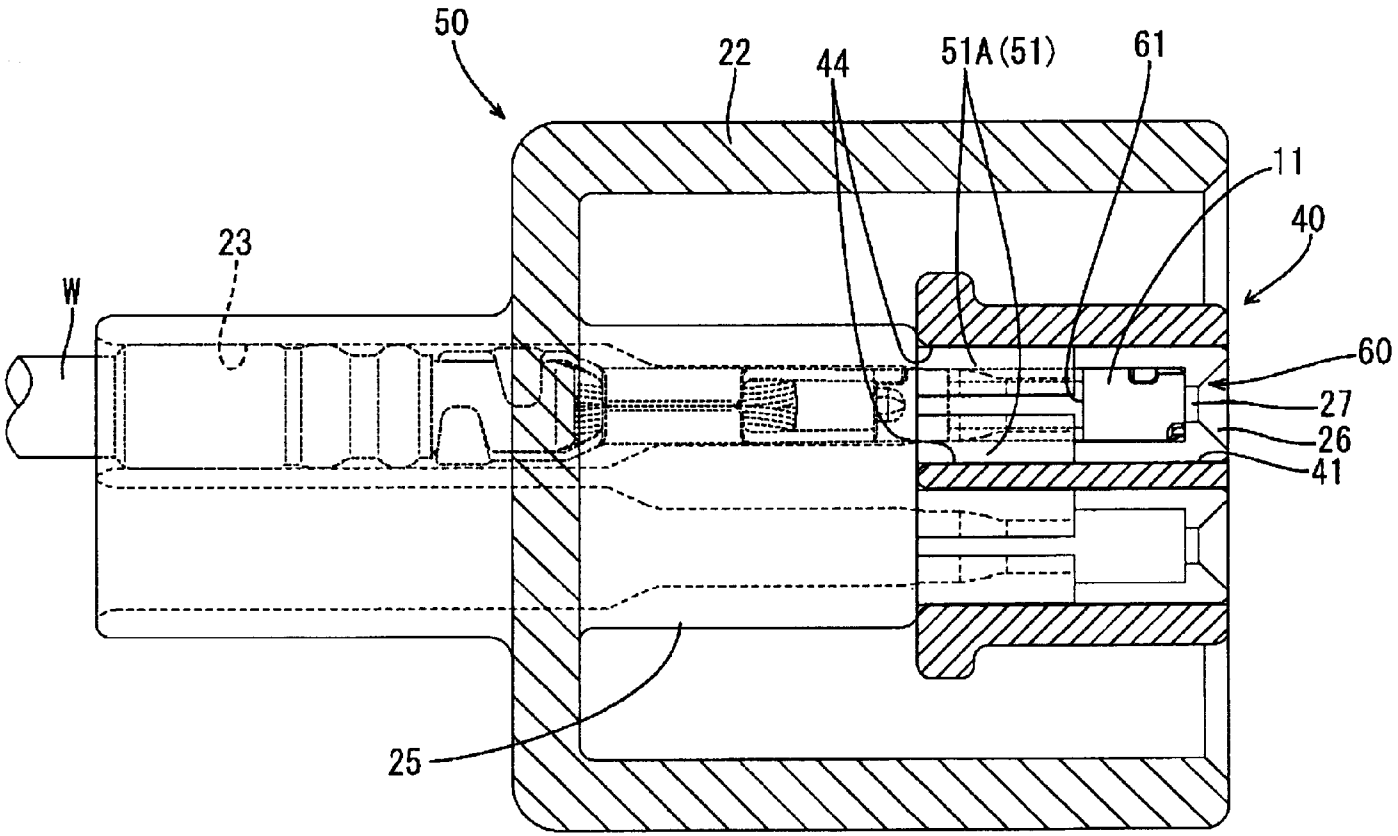
FIG. 15 is a top plan view, partly in section and similar to FIG. 14, but showing the locks engaging the terminal fittings and the retainer fully mounted.
Figure 16:
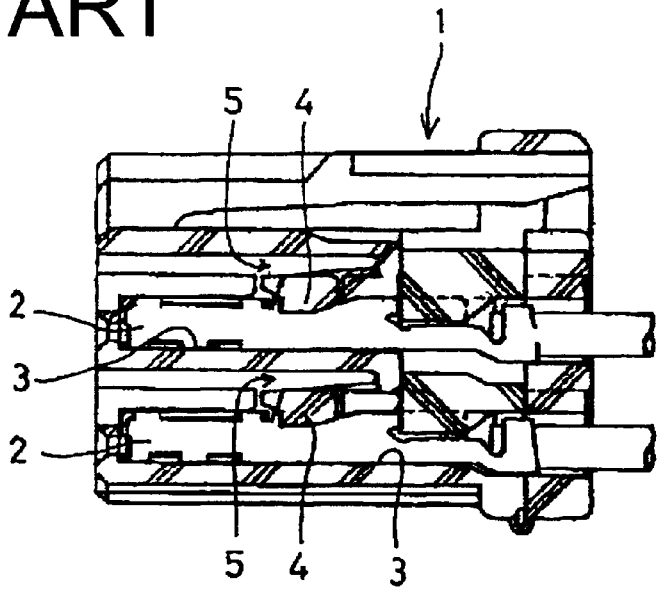
FIG. 16 PRIOR ART
FIG. 16 is a longitudinal vertical section of a prior art connector.

The locks 52 are restored resiliently to their original shapes when the female terminal fitting 60 reaches a proper position and contacts the front wall 27. Thus, the locking sections 52 enter the engaging portion 61, as shown in FIG. 15, to achieve partial locking of the female terminal fitting 60.

The retainer 40 is pushed back to the full locking position after the female terminal fittings 60 are mounted into all the cavities 23. The deformation preventing portions 44 then become located along the outer side surfaces of the side walls 51B of the respective locks 51, and thereby prevent the resilient deformation of the locks 51. As a result, the female terminal fittings 60 are locked doubly. In this way, the assembling of the female connector is completed.

If any of the female terminal fittings 60 erroneously is left partly inserted, the opening edge of the through hole 41 of the retainer 40 contacts the leading ends of the locks 60 to prevent movement of the retainer 40 to the full locking position. Thus, an operator can notice an insufficient insertion of the female terminal fitting 60.

The female terminal fitting 60 is detached by returning the retainer 40 to the partial locking position. The leading end of a disengaging jig J then is inserted through the jig insertion opening 45 of the retainer 40 and into the jig inserting space 32 between the pair of locks 51. The locks 51 then are pushed horizontally away from each other and are deformed obliquely up to disengage the locking sections 52. The female terminal fitting 60 then is withdrawn from the cavity 23 by pulling back on the wire W.

The connector of the second embodiment achieves the same advantages and effects as the first embodiment. However, more secure locking forces can be achieved because two locks 51 engage each terminal fitting 60. Additionally engagement is achieved at opposite sides of the terminal fitting 60 and hence locking forces on each terminal fitting 60 are balance. Furthermore each terminal fitting 60 is locked from both sides and the top. Hence, locking forces are more secure.

Furthermore, the pair of locks 51 can be disengaged at once by inserting the disengaging jig J into the jig inserting space 32 between the locks 51 in the respective pair. Therefore, the locks 51 can be disengaged easily from the female terminal fitting 60.

The present invention is not limited to the above described and illustrated embodiment. For example, following embodiments are also embraced by the technical scope of the present invention. Beside the following embodiments, various changes can be made without departing from the scope and spirit of the present invention.

The present invention is also applicable to male connectors provided with male terminal fittings.

The cross section of the lock could not be L-shaped. For example, the lock may merely define a corner portion or triangle to lock a corresponding corner of the terminal fitting an/or edge regions near the corner of the terminal fitting.

The lock may be formed inside the surrounding wall of the cavity.

What is claimed is:

1. A connector comprising a housing formed with cavities, terminal fittings being inserted into the respective cavities, the terminal fittings having edges defining a corner, each said cavity having at least one resiliently deflectable lock, each said lock being cantilevered along an inserting direction of the terminal fittings and having a first wall extending along a first transverse direction in the cavity and a second wall extending along a second transverse direction substantially normal to the first transverse direction, the first and second walls of the lock engaging the corner of the corresponding terminal fitting.

2. The connector of claim 1, wherein each lock has an L-shaped projection projecting from the first and second walls and engaging the corner of the respective terminal fitting.

3. The connector of claim 1, comprising two of said locks for each cavity, said locks being disposed to engage adjacent corners of the terminal fitting in the respective cavity.

4. The connector of claim 1, wherein each said lock is deflectable in a direction oblique to the respective first and second walls thereof.

5. The connector of claim 1, wherein each said terminal fitting has a rectangular tube, the corner being disposed on the rectangular tube, the lock defining an L-shape conforming to a shape defined by the corner.

6. The connector of claim 1, further comprising a retainer mountable to the housing when the locks are engaged with the corners.

7. The connector of claim 6, wherein the retainer is formed with a jig insertion opening aligned with the lock for enabling deflection of the lock away from the corner.

8. A connector comprising a housing having opposite front and rear ends and a plurality of cavities extending between the ends, portions of each said cavity adjacent the front end defining a rectangular cross section with four corners and diagonals connecting opposed corners, at least one lock cantilevered forwardly adjacent at least one corner of each said cavity, each said lock being resiliently deflectable outwardly substantially along the respective diagonal, terminal fittings mounted in the respective cavities, each said terminal fitting having a rectangular tube formed with an engaging recess aligned with a corner of the rectangular tube and disposed for engagement with the respective lock when the terminal fitting is inserted properly into the respective cavity.

9. The connector of claim 8, wherein each said lock has a concave face facing inwardly toward the respective terminal fitting.

10. The connector of claim 9, wherein each said lock is substantially L-shaped and has two intersecting walls and a corner, the corner being aligned substantially along the respective diagonal of the cavity.

11. The connector of claim 10, wherein each said lock has a locking projection facing inwardly for engaging the respective terminal fitting.

12. The connector of claim 11, wherein each said locking projection is substantially L-shaped and has two intersecting sections engaging intersecting edges at a corner of the respective terminal fitting.

13. The connector of claim 12, further comprising a retainer slideably mountable over the locks when the terminal fittings are inserted completely into the respective cavities.

14. The connector of claim 8, wherein the housing has two locks for each said cavity, the locks being aligned with adjacent corners of the respective cavity and disposed on different respective diagonals.

15. The connector of claim 14, wherein each said lock has a concave face facing inwardly toward the respective terminal fitting.

16. The connector of claim 15, wherein each said lock is substantially L-shaped and has two intersecting walls and a corner, the corner being aligned substantially along the respective diagonal of the cavity.

17. The connector of claim 16, wherein each said lock has a locking projection facing inwardly for engaging the respective terminal fitting.

18. The connector of claim 17, wherein each said locking projection is substantially L-shaped and has two intersecting sections engaging intersecting edges at a corner of the respective terminal fitting.

19. The connector of claim 18, further comprising a retainer slideably mountable over the locks when the terminal fittings are inserted completely into the respective cavities.

* * * * *